US006427499B1

(12) United States Patent
Derman

(10) Patent No.: US 6,427,499 B1
(45) Date of Patent: Aug. 6, 2002

(54) PORTABLE EQUIPMENT SECURITY DEVICE

(76) Inventor: Jay S Derman, P.O. Box 3823, Palos Verdes, CA (US) 90274-9533

( * ) Notice: Subject to any disclaimer, the term of this patent is extended or adjusted under 35 U.S.C. 154(b) by 9 days.

(21) Appl. No.: 09/680,255

(22) Filed: Oct. 5, 2000

(51) Int. Cl.[7] ..... E05B 69/00
(52) U.S. Cl. ..... 70/58; 70/19; 248/551
(58) Field of Search ..... 70/14, 18, 19, 70/57, 58, 30, 49; 248/551–553

(56) References Cited

U.S. PATENT DOCUMENTS 2,655,806 A * 10/1953 Stiler ..... 70/57
4,028,913 A * 6/1977 Falk ..... 70/58
4,598,561 A * 7/1986 Girard ..... 70/58
5,018,374 A * 5/1991 Montano ..... 70/58 X
5,076,531 A * 12/1991 Delaney ..... 248/552
5,732,577 A * 3/1998 Okada et al. ..... 70/18
5,794,464 A * 8/1998 Yeager et al. ..... 70/57
5,836,183 A * 11/1998 Derman ..... 70/58
5,913,906 A * 6/1999 Strocchi ..... 70/18
5,987,936 A * 11/1999 Hartman, Jr. ..... 70/58 X
6,012,739 A * 1/2000 Weiss et al. ..... 70/58 X
6,029,580 A * 2/2000 Alfonso et al. ..... 248/552 X
6,125,669 A * 10/2000 McDaid et al. ..... 70/58
6,126,135 A * 10/2000 Derman ..... 248/551
6,192,722 B1 * 2/2001 Galant ..... 70/58
6,216,499 B1 * 4/2001 Ronberg et al. ..... 70/58
6,237,375 B1 * 5/2001 Wymer ..... 70/14
6,298,695 B1 * 10/2001 Vezina et al. ..... 70/58
6,308,928 B1 * 10/2001 Galant ..... 248/553

* cited by examiner

*Primary Examiner*—Suzanne Dino Barrett
(74) *Attorney, Agent, or Firm*—Monty Koslover

(57) ABSTRACT

A device to secure a PC notebook, a loose-leaf storage book or similarly shaped equipment, using a string of metal rod elongated rectangular links over the opposite and diagonal corners of the equipment, and securing the links using a padlock or other locking device. The links are secured to each other at their short ends by a double hinge that allows the links to pivot in a vertical axis while the hinge surface is held against the side of the equipment. The device is light weight, small in size to facilitate packing for travel, and low in cost.

3 Claims, 2 Drawing Sheets

PORTABLE EQUIPMENT SECURITY DEVICE

BACKGROUND OF THE INVENTION

1. Field of the Invention

The invention relates to devices for securing small, portable equipment and particularly to securing PC notebook computers from theft.

2. Background

The class of personal computers known as PC notebooks describes a computer which is small in size, rectangular in shape and designed to open and close like a book. These PC notebooks are expensive to buy and are commonly used by traveling business persons because of their easy portability, convenient size and shape. However, these desirable characteristics make the equipment vulnerable to theft when left alone in an office or hotel room. Similarly, loose-leaf books that contain compact disks (CD's) or other valuable data are also easily removed and stolen unless safely locked away.

There are a number of security devices presently available for securing PC notebooks and the like. These devices are generally massive, often being larger and weighing more than a PC notebook. This weight and size aspect of a securing device is usually accepted by users for a notebook that will stay in one location. It is seen as an inconvenience for those persons who must travel with their PC notebooks, and therefore, the securing devices may be unused.

In view of the foregoing, it would be new and useful to have available an equipment securing device that is small, light weight and is easily packed with a PC notebook or the like. There is also a need for a small, light weight means for securing a loose-leaf notebook that contains valuable data or property.

SUMMARY OF THE INVENTION

The present invention is a lockable cage that is made using a number of rectangular stainless steel links that are pivotably connected to each other in a string, using special double hinge connectors, both string end links having an unconnected end. The number and length of the links are selected to enable a string of links to fit around the periphery and over the edges of a PC notebook or loose-leaf notebook, with the hinge connectors bearing against sides and blocking CD drives. The end links may then be held together by a padlock or other locking means, forming a cage enclosing an equipment that can be secured by a cable to a fixed post, preventing theft of the equipment.

Accordingly, it is an object of the present invention to provide a securing device for a portable equipment such as a PC notebook, that is light weight and easily packed for travel.

Another object is to provide a securing device for small portable equipment, that is simple to use and is inexpensive.

An advantage of the device compared with prior art devices is the inclusion of an ability to protect the side drives installed in a PC notebook and also prevent opening of the notebook when the equipment is left unattended.

Further objects and advantages of the present invention will be apparent from study of the specification description, the claims and the attached drawings.

DESCRIPTION OF THE PREFERRED EMBODIMENT

Figure 1:
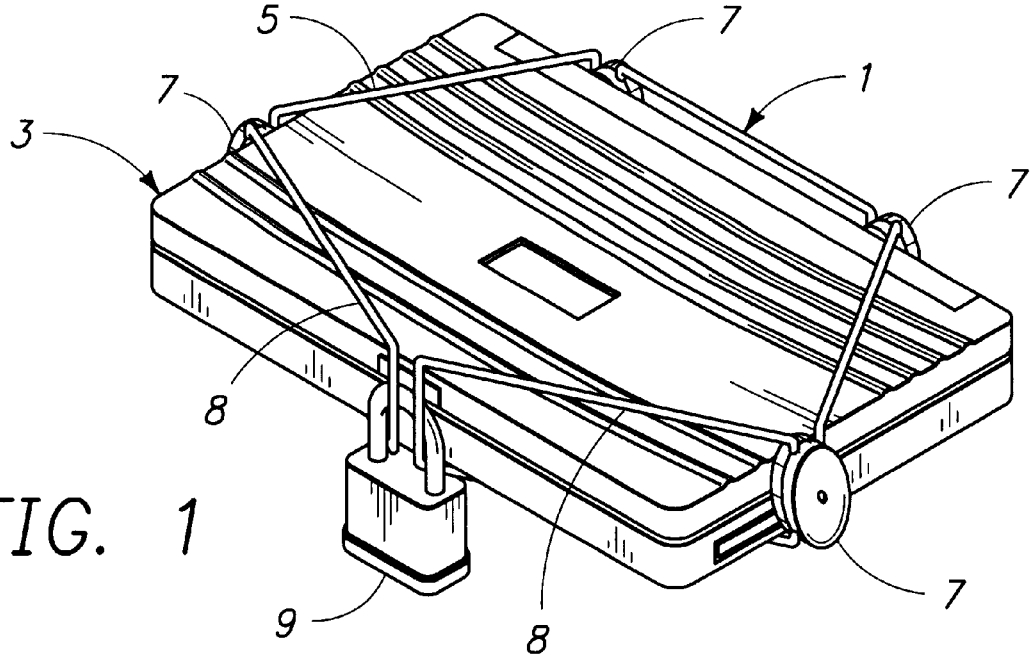
FIG. 1 is a perspective view of a PC notebook enclosed by the present invention equipment security device which is locked by a padlock.

Referring particularly to the drawings, there is shown in FIG. 1 a perspective view of a PC notebook 3 enclosed by the present invention security device 1 and locked by a padlock 9, prior to being secured by a cable or other means to a fixture. The security device 1 comprises a number of rectangular shaped, elongated links 5,8, which are pivotally connected to each other by double hinge connectors 7 in a series string.

As the FIG.1 illustration shows, the security device 1 is placed around the periphery of the PC notebook 3 and the links 5,8, are pulled over the notebook 3 corner edges so that the connectors 7 bear against three sides of the notebook 3. When a padlock 9 or other suitable locking device is used to hold together and lock the free ends of the end links 8, a strong cage is formed around the notebook 3, preventing it from being opened. A cable or other means can then be fastened to the padlock and secured to a fixture, preventing unauthorized removal of the PC notebook.

The connectors 7 are particularly shaped and sized to be capable of blocking drives that are installed in the sides of a PC notebook to prevent anyone from removing the drives, thereby taking data. An example of this blocking action is illustrated in the FIG. 1 view at the right side of the notebook 3.

Figure 2:
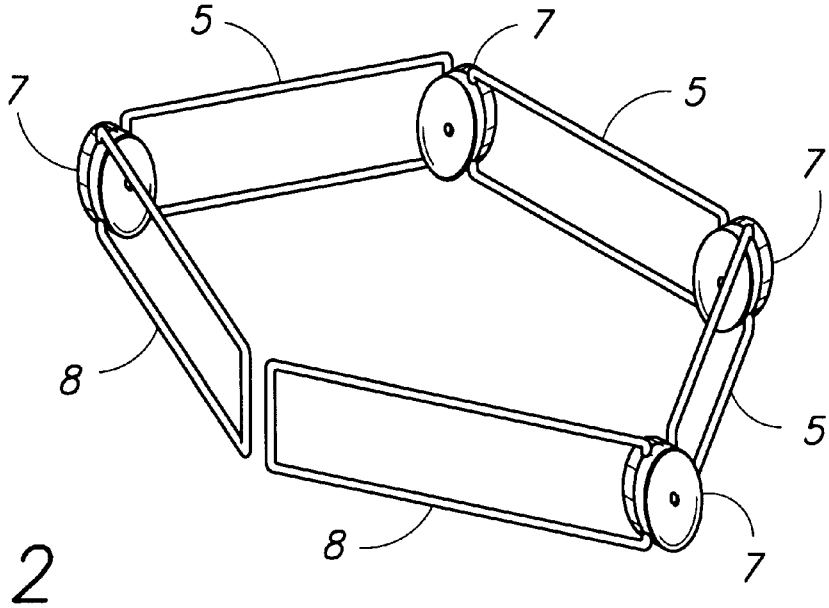
FIG. 2 is perspective view of the equipment security device according to the present invention, showing a number of rectangular links connected pivotably to each other by double hinge connectors.

Refer now to FIG. 2 which is a perspective view of the equipment security device. In this embodiment, the device utilizes a total of five metal links 5,8 and therefore, four connectors 7. The number of links was selected as being optimum for use with a PC notebook. However, the number of metal links 5,8, employed may vary from four to seven, or even more depending on the application of the device.

Among others, typical applications of the invention security device include flat-sided containers such as a loose-leaf book containing data or CD's, an attache case, a tower computer case., and even a desk top computer. This is only a partial list of the equipment which the invention security device may be used to secure.

The size of the metal links 5,8, and the connectors 7 depend on the size of the equipment being protected. For example, the dimensions of PC notebooks are generally, width: 11" to 13", height: 1" to 2.5", depth : 9" to 11". Thus, to allow for fitting the links over equipment corners, the height of a link opening between its long sides will be from 1" to 2.5" plus clearance to fit a particular size PC notebook. The length of the metal links 5,8 depends on the number of links selected and the peripheral measurement of the application. For PC notebook applications, link lengths typically vary from 6.5" to 8".

For strength and security, the links are made of 3/16 in. or greater steel rod, bent to form an elongate rectangular shape, with its open ends welded together. The connectors 7 are made using hard plastic or metal material and consist of two identical planar members held together by a rivet. The result of this construction, is that the security device for use with a PC notebook weighs only about 10 ounces and folds into a small flat package about 8 in. long by 2½ in. wide, making it easy for a traveler to pack with a PC notebook.

Refer now to FIGS. 3, 4, 5 and 6 which show how links 5 are held by connectors 7, permitting the links to pivot and showing detail of a connector 7. The hinge connector 7 is designed to always lay flat against an equipment edge. This is important not only to ensure blocking of any particular area of the equipment side such as CD drives, but also to ensure complete adequate tight caging of the equipment with little space between the equipment surfaces and the security device links.

Figure 3:
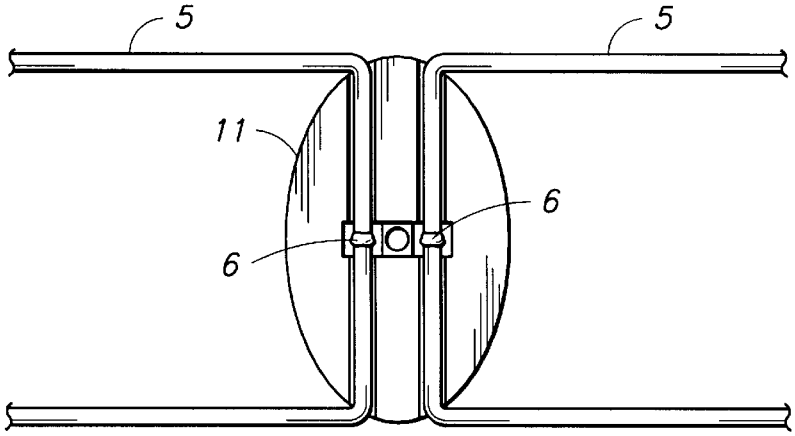
FIG. 3 is a plan view of a portion of the present invention device, particularly showing one half of a hinge connector and how ends of two links are located therein, permitting the links to pivot in a single axis around the connector.
Figure 4:
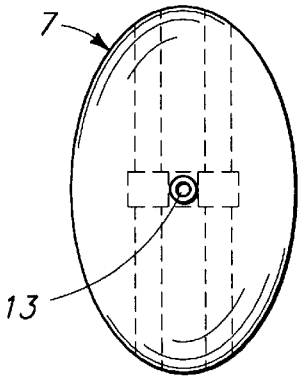
FIG. 4 is a plan view of one of the two identical, parallel faces of an assembled double hinge connector.
Figure 5:
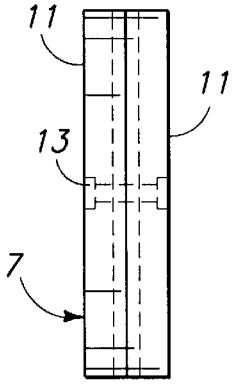
FIG. 5 is a side elevation view of a hinge connector showing its two halves held together by a rivet.

In FIG. 3, the squared and welded 6 ends of two links 5 are depicted lying in separated parallel grooves cut in a face of one of two plate members 11. The plate members 11 match each other in shape and configuration. When the second plate member 11 grooved surface is placed over the first plate member grooved surface and fastened with a center rivet 13, the link 5 ends are held totally in the paralleled tubes formed by the grooves. This creates a hinge, allowing the links to pivot only in a single axis, and thus ensuring that the connectors 7 will always be held flat against an equipment side when the device is installed on equipment.

The connector 7 comprises two matching plastic or metal planar plate members 11 and a rivet 13 that holds the plate members 11 fastened together facing each other. The height of a hinge connector 7 is made approximately equal to the thickness of the portable equipment it is intended to secure, in order to fully enclose the link pivoting ends.

The plate members 11 are made wide enough to ensure blocking a drive or port in any side of an equipment. As shown in the embodiment, the hinge connector shape is ovoid. However, it could also be circular or rectangular, depending on the application.

Figure 6:
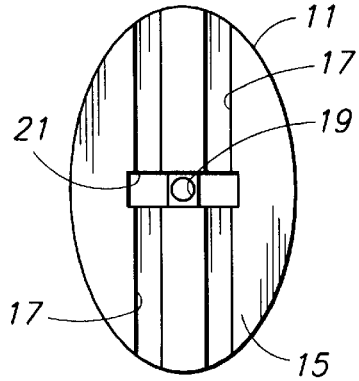
FIG. 6 is a plan view of one connector half, particularly showing grooves for receiving and seating the ends of links.

Refer now to FIG. 6 which shows the inside face 15 of a plate member 11. Two parallel grooves 17 are cut in the face surface 15, and a hole 19 for a rivet is bored in the plate member center between the parallel grooves 17. The grooves are each made wide and deep enough to seat an end side of a link 5 with part of the link side protruding above the groove.

The horizontal center axis of the plate member face 15 includes a recessed portion 21 that is cut across both parallel grooves 17 and is deeper than the grooves. This recessed portion provides rotating space for the welds 6 on the end sides of the links when the links are encased in the hinge disks 7. In addition, to provide room for seating the rivet heads, the rivet hole 19 is countersunk and recessed on the outer, flat side of the plate member 11, providing a flat, smooth surface for bearing against an equipment side.

The device as described above is seen to be light in weight and convenient for use by an individual or for carrying. It has a simple construction and is economic to manufacture and should therefore be relatively low in cost for a user.

The device is also versatile and can come in sizes to fit a wide range of portable equipments including the illustrated PC notebook. From the foregoing description, it is plain that the objects of the present invention have been met.

Alternative embodiments and modifications may be apparent to those skilled in the art. These alternatives and modifications are deemed to be within the spirit and scope of the present invention.

Having described the invention, what is claimed is:

1. A caging device for securing an equipment having generally flat, paralleled surfaces and sides from theft, said device comprising:

a multiplicity of metal links; and a multiplicity of hinge pivot means that pivotally connect said links to each other to form a string of links;

said hinge pivot means including two matching plate members and means for fastening the plate members together, face to face; said plate members each having a flat, smooth side defining an an outer side and a parallel side that incorporates a pair of vertical grooves, defining an inner side, said grooves being sized each to allow a vertical end of a rectangular link to be inserted and seated; said plate members, after being fastened together, allowing seated links to pivot with respect to said plate members in a single, vertical axis as a hinge, and permitting an outer side of said plate members to bear flat against a side of said equipment;

each said rectangular link in said string of links being sized to fit around the periphery of a planar flat-sided equipment, passing over and surrounding the edge portions of said equipment; said device effectively caging said equipment when said device is installed around said equipment and the two free ends of said string of links are locked and held closely together.

2. The device according to claim 1 wherein said plate members are dimensioned having a height approximately equal to the thickness of said equipment, and a width sufficient to block access to any drive or port that is encased in the side of said equipment.

3. The device according to claim 1 wherein said plate members are made from metal material.

* * * * *